United States Patent [19]

Arendt

[11] 4,078,810

[45] Mar. 14, 1978

[54] PISTON TYPE SEAL UNIT FOR WELLS

[75] Inventor: Henry P. Arendt, Dallas, Tex.

[73] Assignee: Otis Engineering Corporation, Dallas, Tex.

[21] Appl. No.: 723,216

[22] Filed: Sep. 14, 1976

[51] Int. Cl.[2] ..... B65D 53/00; E21B 33/12

[52] U.S. Cl. ..... 277/116.4; 277/207 R; 277/103; 92/251; 166/153

[58] Field of Search ..... 166/153, 156; 92/192, 92/249, 251; 15/104.06 R; 277/3, 27, 121, 102, 205, 207 R, 103, 208, 212 R, 116.4, 212 C, 116.6, 113, 213–215, 116.8

[56] References Cited

U.S. PATENT DOCUMENTS

| | | | |
|---|---|---|---|
| 1,925,015 | 8/1933 | Wells | 277/116.4 X |
| 2,172,948 | 9/1939 | Weiler | 277/116.4 X |
| 2,182,251 | 12/1939 | Crickmer | 277/116.4 X |
| 2,257,784 | 10/1941 | Brown | 166/153 |
| 2,271,777 | 2/1942 | Nathan | 285/110 X |
| 2,602,513 | 7/1952 | Conrad et al. | 277/103 X |
| 2,893,493 | 7/1959 | Copas | 277/208 X |
| 2,975,722 | 3/1961 | Webber | 92/251 X |
| 3,102,595 | 9/1963 | Fisher et al. | 166/156 |

*Primary Examiner*—Robert S. Ward, Jr.
*Attorney, Agent, or Firm*—H. Mathews Garland

[57] ABSTRACT

A seal unit for movement through a flow conductor for pumpdown piston or well swab service, including a mandrel body, a seal element mounting sleeve disposed for limited travel on the body, and elastic annular seal means secured on the mounting sleeve to seal with the flow conductor wall in response to a first fluid differential across the unit and to permit controlled bypass and load transfer under a second higher differential. The seal means includes spaced annular lips or fins and an annular choke ring which is expanded by limited sleeve movement in response to a fluid pressure differential load applied across the fins. When the pressure differential across the fins exceeds a predetermined value, the sleeve expands the choke ring which assumes a major portion of the pressure differential load relieving the fins to reduce fin wear. As a pumpdown piston, the unit is pumped along a flow conductor to drive a tool train by fluid flow in a direction from the fins toward the choke ring. As a swab, the unit is pulled in the opposite direction to agitate or displace fluid in a well.

21 Claims, 8 Drawing Figures

PISTON TYPE SEAL UNIT FOR WELLS

This invention relates to seals used in flow conductors and more particularly relates to pumpdown type piston units useful both to drive tools along flow conductors by fluid pressure and as a well swab.

Elastic annular seals have been used to pump various types of tools through flow conductors in well servicing operations. Such systems have special value in wells in remote areas such as sub sea locations which must be serviced either from a shore station or a water surface platform. Unlike typical wire line apparatus in which there is a mechanical wire connection from a wellhead to the tools being operated, in pumpdown operations, a tool failure of the piston units leaves the operator without means to return the equipment to the surface. Thus, durable and reliable piston units are critical for successful pumpdown operations.

Well servicing by pumpdown techniques does not rely on gravity and, thus, adapts very well to applications where vertical access is not practical as in certain sub sea wells and also where wells are crooked or sharply deviated. Pumpdown techniques are also especially useful when depths are extreme inasmuch as they are not limited by wire strength as are conventional wire line operations. Present wire line equipment is not operable much deeper than about 20,000 feet with special problems being encountered under such hostile environments as sour wells and wells in high temperature zones which are especially found in ultra-deep wells.

In large offshore fields, installations are often used involving satellite wells connected to surface platforms by flow-lines laid across the ocean floor. The longest such flowlines presently in use in areas such as the North Sea are about 6,000 feet, though distances as far as 20 miles between wellheads and platforms are under consideration. The recent developments in Alaska present opportunities for the use of pumpdown techniques as wire lines become stiff and brittle at Arctic temperatures.

Pumpdown techniques generally involve the connection of several piston units together in a tool string which also includes stems, accelerators, jars, connectors, and the necessary running and pulling tools required to run, locate, and pull flow controls in a well completion. At the present time, the seal element most frequently used in pumpdown piston units is a swab cup due to the unavailability of elements designated specifically for pumpdown service. Conventional swab cups are designed to mechanically lift liquid from a well conductor by forming a seal with the conductor wall to raise liquid in the conductor above the swab cup. Such swab cups usually include a series of light, relatively flexible fins supported individually or in groups by thicker, inflexible lips. The thin fins follow the contours of the pipe to minimize fluid bypass while the heavier lips carry the major portion of the load as pressure differentials increase. One known swab cup has a form of choke ring with fins, however, the choke ring is not energized by the fins but rather functions entirely independently.

Seal units used as pumpdown pistons are subjected to wear during two principal phases of the operation of such a unit. When the units are employed for transporting tools into and out of wells between a wellhead and the actual location of performing the work for which the tools are introduced, the tools move over long distances, usually operating at a pressure differential of 100 – 300 psi. During such travel, the units may encounter flow conductor collars, welded connections, reduced internal diameter pipe bores, the usual five foot radius loops used for making turns into and out of a wellbore, diverters, locking and locating profiles along the flow conductor surface, side pocket mandrels, tubing safety valves, and other forms of surface configurations and deviations along flow conductor surfaces. The seal units flex or deform to some extent each time they pass through each of these deviations from the usual tubular internal surface of the flow conductors. Abrasion damage is probably the major destructive force to which the seal units are subjected. For example, it has been estimated that a complete round trip through a 20 mile flowline into a 10,000 foot well is comparable to dragging the tool string 44 miles down a concrete highway. Thus, while the pressure differentials are relatively moderate during the transporting phase of the seal unit operation, probably the major damage occurs to the units during this phase because of the numerous changes in flow conditions and the fact that the majority of the unit's useful life is spent during this operating phase.

The other phase of operation of the seal units which causes damage is when the units are actually performing the work for which the tool string is introduced into a well. During this phase of operation, it is very common to use pressure differentials as high as 5,000 psi. Also, pressure surges are commonly used to develop "jarring" effects to perform certain tool operations. It is contemplated that substantially higher pressure differentials and high temperatures will be used in future well servicing operations employing such seal units.

Seal units used for propelling tools in flow conductors must be capable of creating an effective seal with the flow conductor wall sufficient for tool strings to be pumped to and from a work location and to perform the necessary work in a wellbore while at the same time not totally blocking flow through the flow conductor. Such units, thus, must be capable of bypassing a controlled amount of fluid at a given pressure differential for a number of different purposes, including washing ahead of the tool string for cutting paraffin, permitting pressure to reach other downstream pistons in the tool string, to propel additional seal units either within the tool string or within a second tool string which may have to be pumped into the flow conductor in the event the original tool string gets stuck, and to eliminate the possibility of completely plugging the flow conductor.

Presently available seal units most generally fail due to broken lips rather than systematic wear. It is believed that such units are being subjected to requirements beyond the design capacities of the units.

Contemplated future requirements for tool string propulsion seal units include severe chemical, thermal, pressure, and longevity requirements within predicted conditions. With respect to the chemical environments in which the units may operate, there will be $H_2S$ in concentrations ranging up to as high as 50 percent, $CO_2$ in increased percentages, more extensive use of corrosion inhibitors which protect the metal but tend to destroy the elastic portions of the seal unit, and the use of dry gas as the propelling fluid. Thermally, the seal units may be expected to encounter sub zero temperatures as low as −60° to as high as 180° F. during storage, and during actual use as high as 250° to 500° F. Currently, such units encounter fluids which include sweet crude, water, salt water, diesel, condensate, light oils with inhibitors or additives, and gasses including methane, ethane, butane, and related gasses, and miscellaneous contaminants including $H_2S$, $CO_2$, caustics, chlorides, and inhibitors such as alcohols, amines, and the like.

Pressure requirements for the seal units, as previously indicated, may run as high as 5,000 psi at ambient pressures which may exceed 25,000 psi. The service life requirements of such units, in order to preclude excessive cost due to premature equipment failure, are extreme. For example, such units should travel before replacement 250,000 feet at a minimum for standard operations, up to as high as 1,000,000 feet under optimum conditions, and no less than about 50,000 feet under extreme duty applications. They may be called upon to move as long as 30 hours for a distance of 60,000 feet at up to 500° F. and 25,000 psi ambient temperature, and pressure regulator with virtually no bypass differentials at as high as 500 psi where caliper surveys are being run in ultra-deep wells. In flowlines it may be expected that the units may run up to 200 miles for calipering, pigging, scraping, plastic coating, locating leaks, and the like. In some sub sea operations, it may be expected that a tool string including the seal units may remain in the well in a well fluids environment for as long as 90 days between uses.

Well swabs are used to displace fluid from wells, to agitate fluid in wells, and in similar functions. The swab is normally pulled or driven mechanically along a well by a cable or a tubing handling string. Currently available swabs not only are deficient as swabs but also are not designed for the extreme requirements imposed on pumpdown pistons.

It is, therefore, a principal object of the invention to provide a new and improved piston type seal unit for use as a fluid driven locomotive to propel tools along a flow conductor or as a well swab to lift liquid from wells.

It is another object of the invention to provide a piston unit of the character described which utilizes a combination of flexible annular lips and a deformable choke ring wherein the pressure differential imposed load on the seal is transferred from the lips to the choke when the differential increases above a predetermined value.

It is another object of the invention to provide a seal unit of the character described wherein the lips flare out against the conduit wall to prevent fluid bypass at the low pressure differentials, the lips distort to permit a predetermined fluid bypass at intermediate pressure differentials, and the choke portion of the seal unit is expanded at higher pressure differentials transfering the force applied to the seal unit responsive to the presssure differential from the lips largely to the choke.

It is another object of the invention to provide a seal unit of the character described wherein both the lips and the choke of the unit permit fluid bypass along the flow conductor around the unit at higher pressure differentials.

It is another object of the invention to provide a seal unit of the character described wherein the expansion of the choke ring is determined by the travel distance permitted the mounting sleeve to provide a predetermined bypass of fluid around the choke ring.

It is another object of the invention to provide a seal unit of the character described wherein the finned or lip portion of the unit is bonded to a longitudinally movable sleeve which applies an expanding force to the choke portion of the unit when the pressure differential across the finned portion exceeds a predetermined value to expand the choke for transferring a major portion of the pressure differential imposed load on the unit from the finned section to the choke section.

It is another object of the invention to provide a piston unit of the character described wherein the choke section of the unit expands sufficiently when all of the fins of the unit have folded over responsive to a fluid pressure differential for the choke section to provide enough flow restriction to carry the major portion of the pressure differential imposed load on the unit.

It is another object of the invention to provide a piston unit of the character described including fins or lips having a special square cross section which increases toward the root of the fins to provide a consistent fold-over and to provide adequate edge material for wear.

It is another object of the invention to provide a seal unit of the character described wherein the finned portion of the unit is sealed by an O-ring with the body mandrel of the unit whereby the cross sectional area between the root of the fins and the O-ring seal is acted upon by the pressure differential produced by the expanded choke of the unit resulting in a force which maintains the choke expanded.

It is another object of the invention to provide one embodiment of a piston unit of the character described including a slidable sleeve on a body mandrel and seal means comprising a plurality of annular lips or fins and an expandable annular choke mounted on the sleeve which is bonded to the seal means along the length of the lip section and about one half of the choke section.

It is another object of the invention to provide a piston unit of the character described having seal means comprising an integral annular elastic member having a finned or lip section and a deformable choke section.

It is another object of the invention to provide a piston unit of the character described which includes annular elastic seal means comprising a first finned or lip section and a second separate deformable choke section.

It is another object of the invention to provide a piston unit of the character described which includes an elastic annular seal means adapted for rough operation at high pressure wherein a portion of the choke section is bonded to a sleeve without a rigid annular back-up section.

It is another object of the invention to provide a piston unit of the character described having an annular seal means wherein a portion of the deformable choke section is bonded to a sleeve section having an external annular back-up flange.

It is another object of the invention to provide a piston unit of the character described having annular elastic seal means including a first finned or lipped section bonded on a longitudinally movable sleeve mounted on a body mandrel and a separate spaced deformable choke section bonded on annular flange back-up members slidably mounted on the body mandrel for squeezing the choke to expand the choke responsive to a longitudinal load on the finned section.

In accordance with the invention, there is provided a seal unit for use in a flow conductor as a pumpdown piston or as a well swab including a body mandrel having at least one end for connection with a driven tool or a driving member, a sleeve mounted for limited longitudinal travel on the mandrel body, and elastic seal means mounted on the sleeve comprising a finned or lipped section bonded with the sleeve and a choke ring expandable responsive to longitudinal travel of the sleeve effected by application of a fluid pressure differential across the finned section in excess of a predetermined value. The lips or fins each has a cross section which increases toward the root and has a special square outer edge providing a uniform or consistent fold-over and adequate edge material for wear. At low pressure differentials applied for transporting the piston and connected tools to a flow conductor, the lips or fins flare outwardly forming a seal with the flow conductor wall preventing fluid loss and causing the piston and tools to move through the flow conductor. At higher pressure differentials, the fins fold over allowing flow past the fins and applying a force to the sleeve driving the sleeve toward the choke causing expansion of the choke to further restrict flow past the choke. The travel of the sleeve is limited to permit only a predetermined expansion of the choke to a maximum diameter which still permits flow past the fins and the choke while allowing the choke to assume the major portion of the load applied to the piston due to the pressure differential thereby relieving the lips to minimize lip wear. By changing the travel distance allowed the sleeve, the choke ring expansion may be increased or decreased. Such travel distance is controlled by the spacing between the sleeve and a stop shoulder. In one form of the piston, the elastic seal means is an integral member including both the lip section and the choke section with the full length of the lip section and about half of the choke section being bonded to the sleeve while a major portion of the remainder of the choke section is seated in a back-up insert which is not bonded to the choke. In another form of the piston unit, the remaining end portion of the choke section is bonded to a short back-up sleeve section alone without the use of a back-up flange. In a further form of the piston unit, the remaining end portion of the choke is bonded to an integral sleeve and back-up flange. In a still further form of the invention, the choke section of the seal element is independent of the lip section and confined between two back-up rings one of which is squeezed toward the other by the pressure differential force applied to the lip section. In one form of this latter embodiment, the sleeve to which the lip section is bonded extends in a non-bonded loose relationship into the choke section with an external flange on the sleeve between the lip section and the adjacent back-up flange for applying the pressure differential imposed force on the lip section to the back-up flange to expand the choke section.

The foregoing objects and advantages of the invention will be better understood from the following detailed description of the preferred embodiments thereof taken in conjunction with the accompanying drawings wherein.

Figure 1:
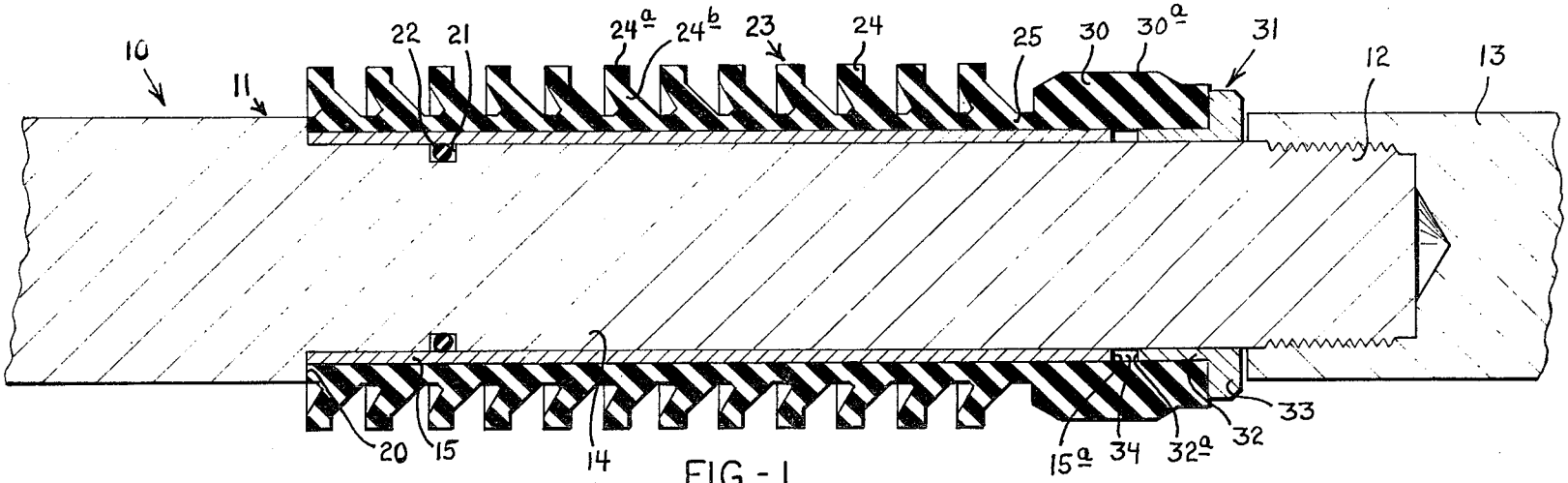
FIG. 1 is a longitudinal view in section of one form of piston unit embodying the features of the invention.

Referring to FIG. 1 of the drawings, a seal unit or piston 10 constructed in accordance with the invention includes a mandrel body 11 having a reduced externally threaded pin portion 12 on which is threaded a mandrel cap 13. The mandrel body has a reduced longitudinal central portion 14 on which a mounting sleeve 15 is slidably supported for limited longitudinal travel. The reduced portion 14 extends from an external annular stop shoulder 20 on the mandrel body to the threaded pin portion 12. The reduced portion 14 of the mandrel body is provided with an external annular recess 21 in which a ring seal 22 is disposed for sealing around the body portion 14 with the mounting sleeve 15.

An annular elastic seal element 23 is mounted on the mandrel body 11 over the mounting sleeve 15. The seal element as illustrated in FIG. 1 is an integral member having a plurality of longitudinally-spaced external annular lips or fins 24 formed along the length of a tubular core 25 which connects with a deformable annular choke 30. The choke 30 has a central enlarged boss portion **30*a*. The seal element 23 is bonded to the mounting sleeve 15 extending along the full length of the finned section of the element and approximately one half of the choke 30. The free end portion of the choke 30 is supported on an annular backup insert 31 having a sleeve portion 32 fitted into the choke 30. The back-up insert has a flange portion 33 fitted against the end edge of the choke 30. The length of the back-up insert 31 along the sleeve portion 32 is gauged to provide a gap 34 within the choke between the inside end edge 32a of th sleeve portion 32 and the adjacent end edge 15*a* of the mounting sleeve 15 to permit limited longitudinal movement of the sleeve 15** toward the back-up insert, as discussed in more detail hereinafter.

Each of the fins or lips 24 of the elastic element 23 has an essentially square outer edge configuration **24*a* to provide adequate material for wear as the result of frictional action between a flow conductor wall and the seal element. The cross section of the body of each of the fins 24 as designated at 24*b* increases in thickness as measured along the longitudinal axis or length of the element 23 radially inwardly toward the root of each fin at the sleeve shaped core 25. This increasing cross section of the fins causes the fins to perform in essentially the same manner as a constant-stress beam to provide consistent or uniform fin fold-over. The element 23** is formed of an elastomer capable of performing in the extreme chemical, thermal, and pressure environments in which the piston unit is to be operated. One elastomer which may be used is polyurethane.

Figure 2:
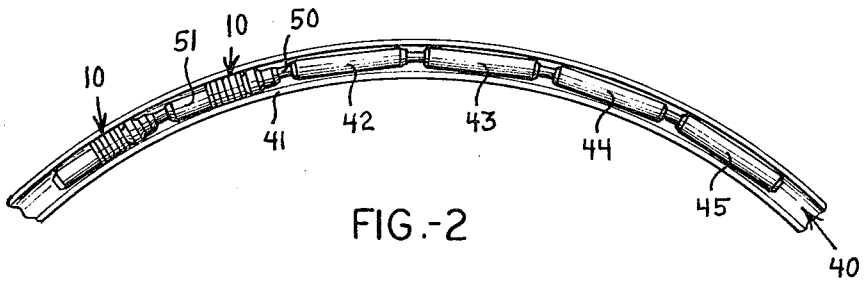
FIG. 2 is a fragmentary view in section and elevation of a tool train employing two of the piston units positioned for travel along a flow conductor loop.

The opposite ends of the piston 10 are each provided with a suitable coupling such as a ball or socket, not shown, for connection of the piston in a pumpdown tool string. Such a tool string 40 is illustrated in FIG. 2 disposed for movement along a typical conduit entry or exit loop 41 employed in a well pumpdown system. As illustrated in FIG. 2, two of the piston units 10 are connected in tandem with a string of tools 42, 43, 44, and 45. Each of the piston units 10 may be provided with a standard ball joint coupler fitting 50 at one end and a socket fitting 51 at the opposite end as illustrated at page 22 of Otis Engineering Corporation Catalog No. OEC5113 entitled PUMPDOWN COMPLETION EQUIPMENT published in May, 1975. Each ball joint, of course, forms a universal coupling with an adjacent socket in a piston unit or tool connected thereto. The various tools 42 – 45 may comprise numerous combinations from a family of pumpdown tools including such units as relief valves, control valves, paraffin cutters, pulling tools, hydraulic jars, accelerators, and the like, as illustrated in the Otis PUMPDOWN COMPLETION EQUIPMENT catalog, supra. Depending, of course, on the particular load or force requirements of the servicing steps to be performed, several of the piston units 10 may be connected in tandem for displacing a tool train along a flow conductor. As illustrated in FIG. 2, two such piston units 10 are coupled with a string of four tools to be propelled through conduit 41. Since the pistons 10 are unidirectional in the sense that they are pumpable in one direction and bypass fluid in the opposite direction, it is necessary to install pistons facing in both directions in order to pump a tool string to a given location in a well and to return the tool string to the surface end of the well. For example, if a single piston unit is capable of carrying the tool string in one direction, the two piston units illustrated in FIG. 2 would face in opposite directions to permit the tool string to be pumped in both directions in the conduit. Generally speaking, more than one piston unit would be included in each set installed in a given direction.

In the operation of the piston unit 10, one or more of the units is connected into a pumpdown tool string as represented in FIG. 2 for displacing the tool string through the flow conductor 41 in response to the application of fluid pressure in the flow conductor behind the tool string. The flow conductor may be included in any one of the numerous well installations of the type represented in the Otis Engineering Corporation catalog entitled PUMPDOWN COMPLETION EQUIPMENT, supra. The fluid pressure is applied in the flow conductor behind the tool train such as at a wellhead to impose a pressure differential across the seal element 23 on the piston 10. As the fluid pressure is applied behind the piston, the pressure against the fins or lips 24 urges the lips forward toward the choke section 30 causing the fins to flare out into sealed relationship along the flow conductor inner wall surface. The pressure is increased to the level required to transport the tool train through the flow conductor at an acceptable rate consistent with safety requirements and proper tool maintenance. In other words, the tool train is not to be pumped at such a high rate that tool damage will occur and possible malfunction of either the tools or portions of the well system may develop. Usually, the pressure differential across the pistons for transporting the tool train will be in the range of from 100 to 300 psi, depending upon tool string size. As the pressure differential load across the seal element increases, the lips are sequentially flared outwardly against the flow conductor wall until the maximum pressure differential is reached prior to fluid bypass occurring along the lips. At this maximum pressure differential which can be sustained by the seal element prior to bypass occurring, the total pressure differential is borne in predetermined increments by each of the lips. At least theoretically, therefore, when the maximum pressure differential is reached at which there is no fluid pypass along the seal element, all of the lips should be flared into effective sealing engagement with the conductor wall surface. During transport of the tool string, it is only necessary that the force from the differential pressure across the piston overcome the frictional resistance to movement of the tool train along the flow conductor together with any additional resistance which may be encountered at collars, welded connections, reduced inside diameter packing bores, the radius loops at the transitions between generally horizontal and vertical movement, and other deviations and restrictions along the length of the flow conductor.

Figure 3:
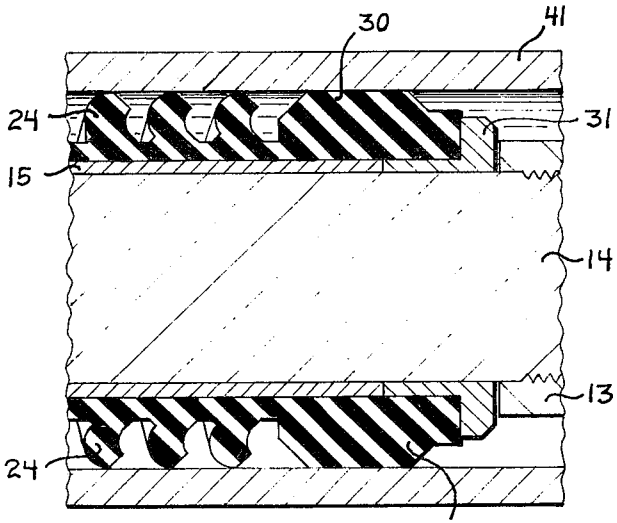
FIG. 3 is an enlarged fragmentary view in section of the seal element of the piston unit illustrated in FIG. 1 showing the fold-over of the lips and the expansion of the choke section when subjected to a fluid pressure differential for displacing the piston along the flow conductor.

When the tool train is required to perform work in excess of that necessary for moving the train along the flow conductor, the pressure differential is increased to the level required to perform such work. As previously indicated, this can reach such high levels as 5,000 psi within an ambient high pressure environment which might be as high as 25,000 psi or more and at elevated temperatures. While substantial wear occurs around the seal element fin edges during the transport phases of the operation of the pistons, major destructive damage may occur along the fins under these extreme high pressure differentials required for the tool train to perform the necessary work. The unique design of the present piston unit whereby the major portion of the pressure differential imposed load is transferred from the fin section of the seal element to the choke section minimizes such fin damage at the high pressure differentials. As the pressure differential is increased to perform the necessary work, the fins bend or fold forwardly and inwardly in a downstream direction toward the direction of movement of the tool train. The fins fold past center so to speak so that the fins begin to retract from the flow conductor wall allowing fluid bypass along the fin edges within the flow conductor. As this pressure differential increases, the novel design of the piston unit comes into play. The pressure differential being applied across the seal element 23 is effective over an annular area between the root of the fins and the line of sealing engagement between the O-ring seal 22 and the inside wall surface of the mounting sleeve 15 as bypass occurs along the fins due to the folding over of the fins. The effective force applied to this effective annular area by the differential pressure urges the mounting sleeve 15 and that portion of the seal element 23 bonded to the sleeve longitudinally along the mandrel body section 11 of the piston toward the choke section 30. The free end of the choke section is seated in the back-up insert 31 limiting the movement of the choke so that as the mounting sleeve applies a longitudinal squeezing force to the choke, the choke is expanded radially outwardly further restricting the annular flow space around the choke within the flow conductor wall. By the time that all of the fins 24 have folded over, the choke is expanded sufficiently to provide a flow restriction which imposes the major portion of the load from the pressure differential across the element 23 on the choke a distinguished from loading the fins. The mounting sleeve 15 is movable toward the choke until the end edge **15*a* of the sleeve engages the end edge 32*a* on the back-up insert closing the gap 34 between the sleeve and the back-up insert. The seal element 23, the length of the gap 34 between the sleeve 15 and the back-up insert, and the related parts of the piston unit are designed to limit the expansion of the choke 30 to provide bypass around the choke within the flow conductor when the choke is fully expanded by the maximum movement of the mounting sleeve. This condition is represented in FIG. 3 which shows the fins 24 folded over inwardly away from the conduit wall allowing bypass along the fins and the choke at maximum limited expansion spaced from the wall due to the full seating of the mounting sleeve end edge 15***a* with the back-up insert end edge 32*a*.

It is important that the choke is not expanded sufficiently to shut off most or all of the flow for a number of previously discussed reasons, including, the need for continuous flow capability along the flow conductor to pump in other tool trains and the like together with undesirable effects from a full shut off by the choke. For example, if the choke shuts off most of the flow, the fins relax thereby reducing the expanding force of the sleeve 15 on the choke causing the choke to relax, contract, and lose pressure so that the fins then are reactivated by expansion which again compresses the choke to again shut off flow. This cycling produces surging which is unpredictable and causes undesirable pressure fluctuations. The flow rate/pressure differential/bypass rate ratio is selectively altered by changing travel limits of the sleeve 15 by varying the length of the back-up insert and/or the back-up insert diameter which can vary the effective extrusion gap of the choke section. Such ratio preferably provides a choke expansion which causes a pressure drop gauged to keep the choke fully expanded.

It will be recognized that once the sleeve 15 seats against the back-up insert causing maximum expansion of the choke 30, the full force of the pressure differential across the piston unit is applied to the mandrel body 11 rendering such force available for work to be performed by the tool string. The increasing cross section of the fins toward the fin roots causes the fins to fold over evenly or consistently. So long as the pressure differential is maintained above a level which keeps the choke 30 fully expanded, the fins will remain folded over as shown in FIG. 3 and bypass flow will occur along the flow conductor around the piston seal element 23. Of course, to return the tool train from the work location in the flow conductor the pressure differential direction is reversed so that the fins on the operating pistons fold back in the opposite direction with the piston generally returning to the condition illustrated in FIG. 1 at which the element 23 is relaxed, while the piston 10 facing in the opposite direction in the tool train takes over the load and performs in the same manner as previously described to withdraw the tool train from the work area and transport the train back to the surface end of the well system. The return trip, of course, may require certain work functions in addition to the transporting of the tool string along the flow conductor. For example, if some form of running tool is engaged with a well system unit operated by the tool, it may be necessary to release the running tool, close the valve, or perform other functions which require some work in excess of that to simply transport the tool string back to the surface. During the performance of such work, the piston 10 which has taken over the load will operate in the same manner as peviously described.

Figure 4:
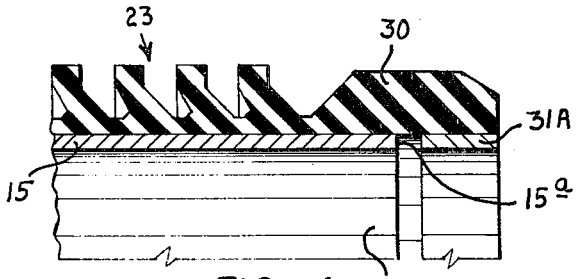
FIG. 4 is a fragmentary view in section of another form of piston unit embodying the features of the invention.

FIGS. 4 – 8, inclusive, illustrate variations in piston configurations including the features of the invention to provide certain options in the performance characteristics of the pistons depending upon the back-up structure and seal element design employed. Referring specifically to FIG. 4, an integral seal element 23 as previously described is mounted and bonded on the sleeve 15 along the length of the finned section and approximately one-half of the choke section. A back-up insert sleeve 31A is fitted within and bonded to the end portion of the choke 30 in spaced relation with the end edge 15*a* of the sleeve 15. An end flange is not provided on the back-up insert 31A. Otherwise, the piston represented in FIG. 4 is constructed with identical features as those shown in FIG. 1. This form of the piston is useful for rough operation under high pressure conditions.

Figure 5:
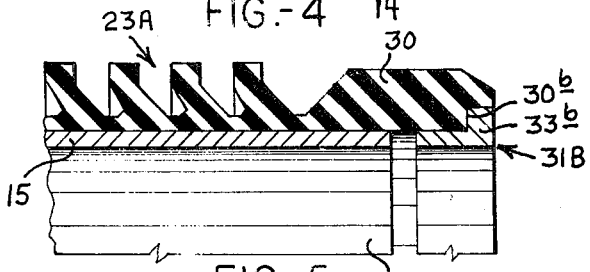
FIG. 5 is a fragmentary view in section of a further form of piston unit embodying the features of the invention.

The piston represented in FIG. 5 includes a seal element 23A which is substantially identical to the seal element 23 provided, additionally, however, with a counter-sunk internal annular recess 30*b* in the end face of the choke 30. The seal element 23A is mounted on and bonded to the sleeve 15 along the length of the finned section and approximately one-half of the choke section. A back-up insert 31B is fitted into and bonded with the end portion of the choke 30. The back-up insert 31B has a flange portion 33*b* which is counter-sunk in the recess 30*b* of the choke. The choke is bonded to the back-up insert along all surfaces of the insert which engage the choke.

Figure 6:
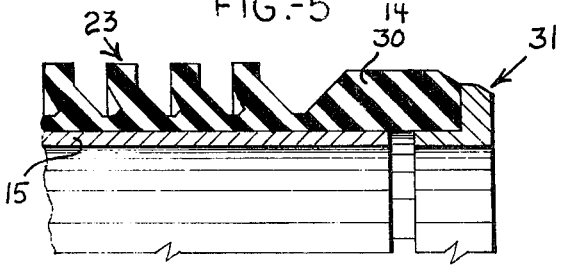
FIG. 6 is a fragmentary view in section of a still further form of piston unit embodying the features of the invention.

The form of the piston illustrated in FIG. 6 is geometrically identical to the piston unit illustrated in FIG. 1 with the only difference in the structure being that the choke 30 is bonded to the back-up insert 31.

The bonding of the choke section of the seal with the back-up insert, as particularly represented in FIGS. 5 and 6, results in moving the wear area of the choke to a location around the longitudinal center of the choke. Since the choke is bonded both to the sleeve 15 and to the back-up insert, the major portion of the radial expansion of the choke occurs along the center of the choke.

Figure 7:
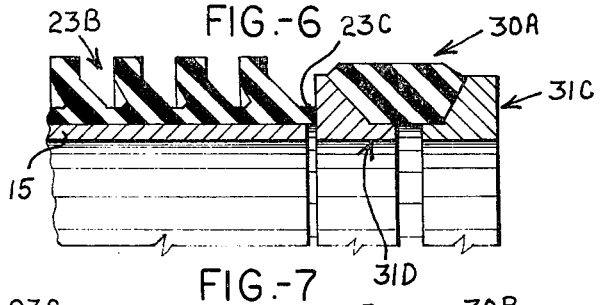
FIG. 7 is a fragmentary view in section of a still further form of piston unit embodying the features of the invention.

The form of the piston illustrated in FIG. 7 includes a seal element arrangement which has a finned section 23B and an independent separate choke section 30A. The finned section is mounted on and bonded to the sleeve 15. The choke section 30A is supported between and bonded to a pair of back-up inserts 31C and 31D which are identical in features, being mirror images of each other, to support opposite end portions of the choke. The finned section 23B has an end edge lip 23*c* which projects beyond the end edge of the sleeve 15 to ensure a fluid tight seal against the back-up insert 31D as the pressure differential applied to the piston urges the finned section with the sleeve 15 toward the choke 30A. The particular piston arrangement represented in FIG. 7 provides a possibility of additional movement or stroke due to the use of the spaced, separate back-up inserts. Additionally, the use of the separate choke section 30A allows the choke to be reversed and/or replaced independently of the finned section in the event of excessive or uneven wear. In the operation of the piston unit shown in FIG. 7, a pressure differential across the piston forces the finned section along with the sleeve 15 toward the choke. The finned section and sleeve forces the back-up insert 31D toward the back-up insert 31C squeezing the choke 30A between the back-up inserts causing the choke to expand radially restricting the flow space around the choke within the flow conductor, as previously discussed. The other features of the piston represented in FIG. 7 are identical to those shown in FIG. 1.

Figure 8:
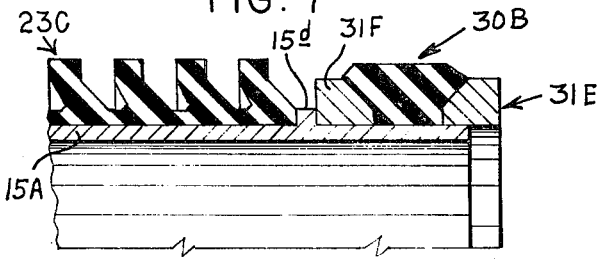
FIG. 8 is a fragmentary view in section of a modified form of the piston unit illustrated in FIG. 7, embodying the features of the invention.

FIG. 8 illustrates a still further form of piston unit embodying the features of the invention using separate finned seal element and choke sections. A finned seal element section 23C is mounted on and bonded to a sleeve 15A. The end edge of the seal element facing the choke engages an external stop shoulder **15*d* formed on the sleeve 15A. A separate choke section 30B is mounted between and bonded to a pair of back-up inserts 31E and 31F which are identical in features and mirror images of each other for supporting opposite ends of the choke section. The back-up inserts and choke section are fitted loosely without bonding on the end portion of the sleeve 15A extending beyond the sleeve flange 15*d*. The other features of the piston unit shown in FIG. 8 are identical to those illustrated in FIG. 1. Application of a pressure differential to the piston represented in FIG. 8 forces the finned section 23*c* with the sleeve 15A toward the choke 30B. The sleeve flange 15*d* urges the back-up insert 31F toward the back-up insert 31E as the sleeve slides within the back-up insert 31E squeezing the choke 30B** between the back-up inserts so that the choke is expanded radially to provide the annular restriction around the choke within the flow conductor as previously discussed so that the choke assumes the major portion of the load applied by the pressure differential across the piston unit. As in the case of the unit shown in FIG. 7, the separate choke section permits replacement and reversal to compensate for excessive or uneven wear.

The various forms of piston units shown here are also useful as well swabs for lifting well liquids, agitating well liquids, and the like, in a well bore. As a swab the piston units may each be supported mechanically on a cable or a rigid handling string such as tubing. In lifting well liquids the liquid load above the piston units applies an energizing load resulting from a pressure differential across the seal element means deflecting the fins to shift the mounting sleeve expanding the choke section as previously described. In lowering the piston unit, the choke section goes down first with the fins folding inwardly allowing bypass permitting the piston to move through the liquid without energizing the choke ring. As the unit is lifted, the fins lead, expanding to lift liquids and energize and expand the choke ring. The controlled bypass along the choke is effective due to the travel limitation on the mounting sleeve. The degree of bypass is, of course, determined by the sleeve travel which is designed into each piston unit.

It will now be understood that each of the various forms of piston units embodying the features of the invention as described and illustrated herein produce a load transfer from a finned section to a choke section when a pressure differential is applied across the piston to reduce fin wear. In each of the piston designs, the mounting sleeve supporting the finned section has a travel limiting feature which expands the choke sufficiently to provide a flow restriction which transfers the effective load from the fins to the choke while limiting the expansion of the choke to preserve a needed flow space around the choke within the flow conductor.

What is claimed is:

1. A piston type seal unit adapted for movement along a flow conductor comprising: a mandrel body; an annular finned seal element on said body; and an annular choke ring on said body in tandem with said finned seal element; said finned seal element being mounted for limited axial movement on said body toward said choke ring; and means associated with said finned seal element and said choke ring to apply a mechanical force to said choke ring to energize said choke ring to expand said choke ring responsive to a pressure differential applied across said finned seal element.

2. A piston adapted to be moved through a flow conductor comprising: a mandrel body; a mounting sleeve supported on said mandrel body for limited longitudinal movement; annular seal element means supported on said mounting sleeve for expansion and contraction responsive to application of fluid pressure to said piston in a flow conductor, said seal element means including tandem finned and choke sections, said finned section being secured to said mounting sleeve for movement of said mounting sleeve along said mandrel body toward said choke section responsive to a fluid pressure differential applied across said piston; means between said mounting sleeve and said choke section for applying a longitudinal force from said mounting sleeve to said choke section to radially expand said choke section responsive to said pressure differential across said piston and back-up insert means engaged with said choke secion for holding said choke section against movement on said mandrel body away from said finned section whereby said choke section is squeezed to radially expand said choke section responsive to said movement of said mounting sleeve toward said choke section.

3. A piston in accordance with claim 2 wherein said seal element means is a one-piece integral structure, said finned section of said seal element means comprising a plurality of longitudinally spaced annular fins connected at one end with said choke section, and said choke section being a ring having a central expandable boss portion.

4. A piston unit in accordance with claim 3 wherein longitudinal movement of said mounting sleeve is limited by engagement of an end of said mounting sleeve with said back-up insert and the space between said mounting sleeve and said back-up insert under non-pressure differential conditions is of a predetermined value limiting the movement of said mounting sleeve to a distance gauged to limit the expansion of said choke section to a maximum diameter within a flow conductor providing an annular space around said choke section to permit fluid bypass along said choke section within said flow conductor sufficient to maintain said choke section expanded.

5. A piston unit in accordance with claim 4 wherein a portion of said choke section toward said finned section is bonded to said mounting sleeve.

6. A piston in accordance with claim 5 wherein an end portion of said choke section away from said finned section is bonded with said back-up insert.

7. A piston in accordance with claim 6 wherein said back-up /insert is a sleeve disposed within the free end portion of said choke section.

8. A piston in accordance with claim 7 wherein said sleeve includes an external annular flange engaged with the free end edge of said choke section.

9. A piston in accordance with claim 7 wherein said back-up insert includes an external annular flange countersunk into the free end of said choke section.

10. A piston in accordance with claim 2 wherein said choke section is a separate member from said finned section.

11. A piston in accordance with claim 10 wherein said choke section is a symmetrical member adapted to be reversed to compensate for excessive and uneven wear.

12. A piston in accordance with claim 11 wherein said back-up means comprises a pair of spaced back-up rings disposed on said mandrel body supporting said choke section between said rings and for squeezing said choke section to expand said choke section responsive to engagement by the end edge of said mounting sleeve facing said choke section with the back-up ring adjacent to said finned section.

13. A piston in accordance with claim 12 wherein the end portion of said mounting sleeve at said choke section telescopes into said insert rings, and said mounting sleeve includes an external annular operating flange positioned between an end edge of said finned section and the adjacent back-up ring.

14. A piston for fluid pressure displacement through a flow conductor comprising: a mandrel body; coupling means on said mandrel body for connecting said piston in a tool string; said mandrel body having a longitudinal reduced diameter portion provided with a stop shoulder at one end thereof; a longitudinally movable mounting sleeve on said mandrel body reduced portion, said mounting sleeve having a first end edge engageable with said stop shoulder on said mandrel body and being adapted for predetermined longitudinal movement on said mandrel body reduced portion; said reduced portion of said mandrel body having an external annular recess provided within said mounting sleeve; a ring seal disposed in said recess around said mandrel body reduced portion for sealing between said mandrel body reduced portion and the inner wall surface of said mounting sleeve; annular seal element means supported on said mandrel body around said mounting sleeve, said seal element means comprising a first finned section having a plurality of longitudinally spaced external annular fins and a tandem positioned second choke section adapted to expand radially to restrict fluid flow along said flow conductor around said piston responsive to a fluid pressure differential applied in said flow conductor across said piston; said fins of said finned section of said seal element means each comprising an external annular member having a peripheral conductor wall engaging lip and body portion supporting said lip of progressively increasing thickness toward a root portion of said fin measured along the longitudinal length of said seal element means for uniform folding responsive to a pressure differential; and back-up insert means on said reduced portion of said mandrel body at the free end of said choke section providing a stop for said choke section away from said finned section whereby said choke section is squeezed longitudinally expanding said section radially outwardly responsive to movement of said mounting sleeve toward said choke section effected by a fluid pressure differential imposed on said piston, said back-up insert means and the end of said mounting sleeve at said choke sections being spaced to permit predetermined movement of said support sleeve toward said choke section for limiting the radial expansion of said choke section to a diameter defining within a flow conductor a predetermined annular flow passage around said choke section within said flow conductor; and said fins on said first seal element section being adapted to fold in a direction toward said choke section to positions permitting fluid flow past said fins in said flow conductor, said support sleeve being adapted to maximum movement toward said choke section for maximum expansion of said choke section when all of said fins are folded to fluid bypass positions providing a pressure drop across said piston gauged to maintain said choke at said maximum expansion.

15. A piston in accordance with claim 14 wherein said seal element means is a unitary structure with said second choke section being connected with said first finned section and said finned section and a portion of said choke section adjacent to said finned section are bonded to the outer surface of said mounting sleeve.

16. A piston in accordance with claim 15 wherein said back-up insert means includes an internal sleeve portion telescoped into the free end portion of said choke section away from said finned section and bonded to said choke section, said sleeve portion having an inward end edge spaced from the downstream end edge of said support sleeve providing a gap of predetermined length defining the movement of said support sleeve for maximum expansion of said choke section.

17. A piston in accordance with claim 16 wherein said back-up insert includes an external annular end flange countersunk into the free end of said choke section.

18. A piston in accordance with claim 16 wherein said back-up insert means includes an external annular end flange engaging the free end edge of said choke section.

19. A piston unit in accordance with claim 14 wherein said choke section of said seal element means is a separate member from said finned section of said seal element means, and said back-up insert means comprises a pair of back-up rings supported in spaced relation on opposite sides of said separate choke section, bonded to and supporting said choke section whereby said back-up rings are squeezed together by longitudinal movement of said support sleeve for expanding said choke section, and said first finned section has an end lip projecting beyond the end edge of said support sleeve adjacent to said choke section for effecting a seal with the adjacent back-up insert ring when said finned section and said support sleeve are urged toward said choke section.

20. A piston in accordance with claim 14 wherein said second choke section is a separate member from said first finned section, said back-up insert means comprises a pair of back-up rings, said rings being supported on opposite sides of said choke section on said body mandrel reduced section and being bonded to said choke section for expanding said choke section when said back-up rings are squeezed together responsive to movement of said support sleeve, and said support sleeve has an end portion telescoped into said back-up rings and an external annular flange engageable with the one of said back-up rings adjacent to said first finned section.

21. A piston in accordance with claim 14 wherein said peripheral lips of said fins on said seal element means are substantially square in cross section.

* * * * *